US005799908A

United States Patent [19]

Downs

[11] Patent Number: 5,799,908

[45] Date of Patent: Sep. 1, 1998

[54] HOLDER FOR PLASTIC BAGS

[76] Inventor: Karen L. Downs, 2823 SE. Taylor, Portland, Oreg. 97214

[21] Appl. No.: 805,470

[22] Filed: Feb. 25, 1997

[51] Int. Cl.[6] ..... A63B 55/04

[52] U.S. Cl. ..... 248/97; 248/99; 248/175

[58] Field of Search ..... 248/100, 97, 99, 248/153, 95, 175; 206/554; 383/12, 33, 119, 104

[56] References Cited

U.S. PATENT DOCUMENTS

| | | | |
|---|---|---|---|
| 447,686 | 3/1891 | Holladay . | |
| 957,652 | 5/1910 | Bush | 248/97 |
| 1,542,164 | 6/1925 | Nelson . | |
| 3,013,758 | 12/1961 | Smith | 248/153 |
| 4,175,602 | 11/1979 | Cavalaris et al. . | |
| 4,620,683 | 11/1986 | Claydon et al. . | |
| 4,623,111 | 11/1986 | Prader . | |
| 4,840,336 | 6/1989 | Stroth et al. | 248/175 X |
| 4,877,207 | 10/1989 | Farah . | |
| 4,893,769 | 1/1990 | Rotelli . | |
| 4,957,252 | 9/1990 | Watkins . | |

*Primary Examiner*—Ramon O. Ramirez
*Attorney, Agent, or Firm*—Kolisch Hartwell Dickinson McCormack & Heuser

[57] ABSTRACT

A holder for collapsible bags, especially plastic bags. The holder includes a base and a support structure that extends generally upwardly from the base and has an upper portion distal the base. The holder further includes a pair of opposed mounts that each are connected to the upper portion of the support structure and are each configured to capture a respective one of the bag's straps. Each mount includes a lower surface for supporting a respective one of the bag's straps in a raised position above the base and an upper surface disposed above the lower surface for selectively retaining the strap within the corresponding mount and preventing the unintentional removal of that strap from the mount. The holder may further include a handle that is removably coupled to the support structure.

22 Claims, 4 Drawing Sheets

Fig. 8
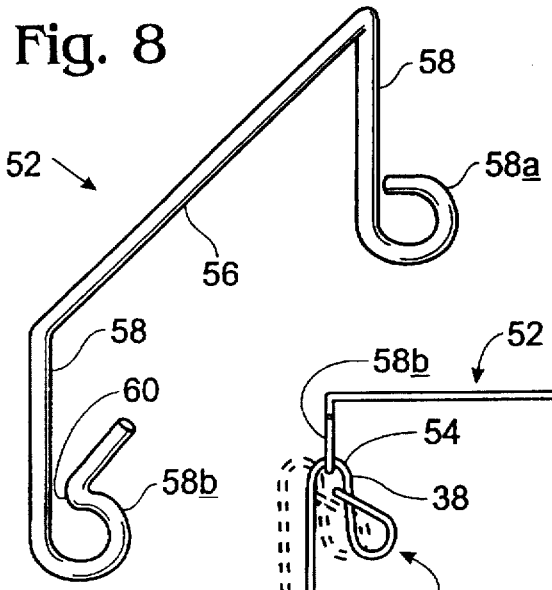
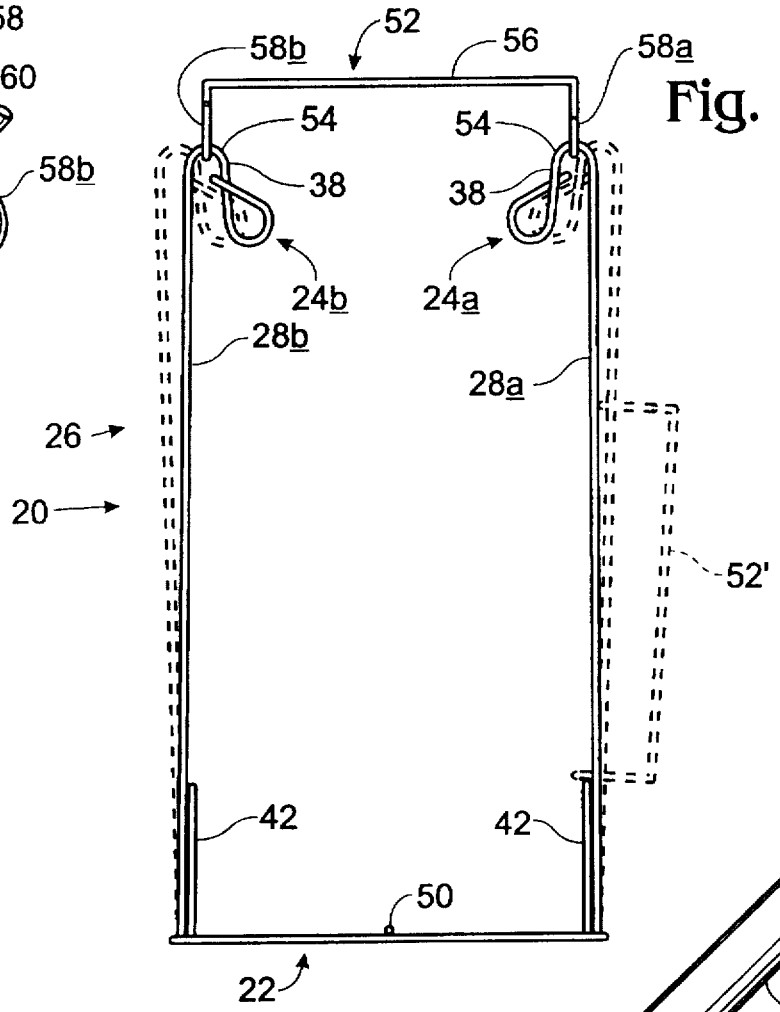
Fig. 9
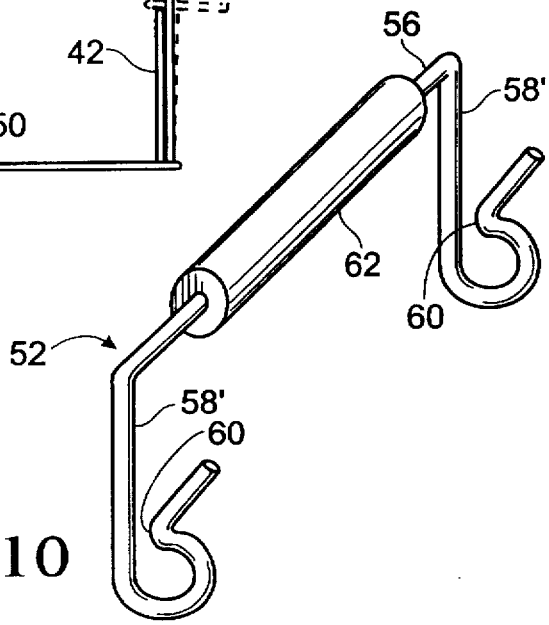
Fig. 10

HOLDER FOR PLASTIC BAGS

FIELD OF THE INVENTION

The present invention relates generally to bag holders. More particularly, it is directed to a holder for plastic bags.

BACKGROUND OF THE INVENTION

In the past, most retail and grocery stores used paper bags to package a customer's purchases. Besides being relatively cumbersome and bulky, the bags required large amounts of paper to produce. After using the bags to transport their purchases, consumers often reused the bags as trash bags. The generally rectangular shape and stiff construction of the bags made them relatively self-supporting and enabled the bags to be used in most conventional trash containers. Because the bags were made of paper, however, they were subject to tearing or otherwise failing when used to hold wet trash. In addition, a further drawback of their paper construction is that even a small tear or rip tended to expand throughout the bag, thereby rendering the bag useless to hold trash or other items.

Today, more and more stores, especially grocery stores, are shifting away from paper bags. Instead, the stores are turning to plastic bags. The bags are constructed of a thin plastic material and are extremely durable and flexible. When empty, they can be reduced to a relatively small size. The bags have a generally rectangular bottom portion and a body that is capable of holding a large capacity of objects. The bags further include a relatively narrow neck or mouth through which objects are inserted into and removed from the bag's body. Adjacent the neck, the bag has a pair of spaced-apart loops or straps that extend upwardly from the neck. The popularity of these bags in retail and grocery stores is, at least partially, a result of their inexpensive material of construction and their large storage capacity.

After being used to transport purchases home, however, the relatively narrow necks and collapsible plastic construction of the bags substantially precludes their use for other applications. Specifically, the bags are ill-suited for use with conventional storage containers. Because of their flexibility, the bags must be maintained in an upright, open position in order to be reused to hold trash or other objects. Conventional storage containers do not include structure designed to meet this need; instead they generally have a hollow box-like or cylindrical configuration with an upper lip that defines an opening through which a bag is placed into the container. Since the containers do not include structure to support the bag's straps, the bags must be stretched or otherwise deformed to fit over the container's lip. This stretching process often results in the bag's narrow neck being torn or ripped when the bag is stretched beyond the limits prescribed by its shape. Even if the bag is supported on the container, it will tend to slip off of the lip and slide into the container. As a result, the bags are usually discarded or simply accumulated in a user's home.

With the above problems in mind, a general object of the present invention is to provide a bag holder that is specifically designed for use with flexible, collapsible bags.

It is another object of the present invention to provide a holder that is specifically designed for use with the narrow-necked plastic bags that are commonly available today.

Yet another object of the present invention is to provide a holder for plastics bags that supports the bags in an open, upright position while preventing the unintentional removal of the bag from the holder.

Still another object of the present invention is to provide a holder for plastic bags that includes a selectively removable or selectively storable handle that provides a mechanism by which the holder may be carried from place to place.

A further object of the present invention is to provide a holder that is rugged enough to tolerate the abuses expected in the operating environment, yet is economical to manufacture by virtue of having relatively few parts.

These and other objects and advantages will be more clearly understood from a consideration of the accompanying drawings and the following description of the preferred embodiments.

SUMMARY OF THE INVENTION

The present invention is a holder for plastic bags. In the preferred embodiment, the holder includes a base and a support structure that extends generally upwardly from the base and has an upper portion distal the base. The holder further includes a pair of opposed mounts that each are connected to the upper portion of the support structure and are each configured to capture a respective one of the bag's straps. Each mount includes a lower surface for supporting a respective one of a bag's straps in a raised position above the base and an upper surface disposed above the lower surface for selectively retaining the strap within the corresponding mount and preventing the unintentional removal of that strap from the mount. The holder may further include a handle that is removably coupled to the support structure.

Many other features, advantages and additional objects of the present invention will become apparent to those versed in the art upon making reference to the detailed description which follows and the accompanying sheets of drawings in which the preferred embodiments incorporating the principles of this invention are disclosed as illustrative examples only.

BRIEF DESCRIPTION OF THE DRAWINGS

FIG. 8 is an isometric view of a handle that is configured to be coupled to the holder shown in FIG. 2.

FIG. 9 is a front view of the handle of FIG. 8 mounted on the holder of FIG. 2. Also shown in FIG. 9, in dashed lines, is the handle in a stored position along a portion of the holder's support structure.

FIG. 10 is an isometric view of an alternate embodiment of the handle of FIG. 8.

DETAILED DESCRIPTION OF THE PREFERRED EMBODIMENTS

Figure 1:
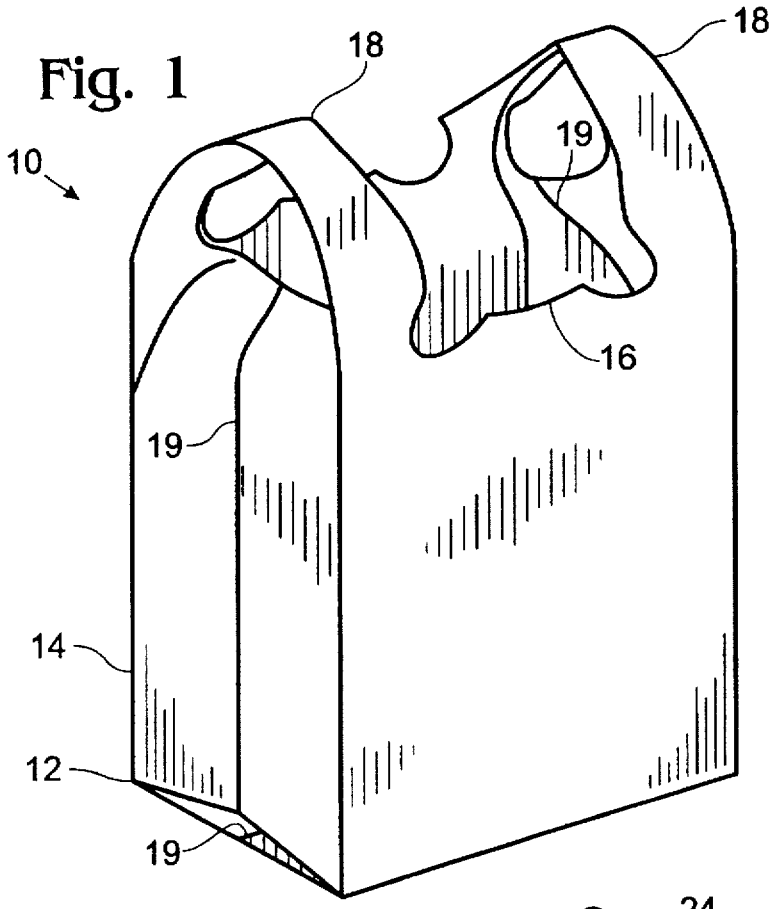
FIG. 1 is an isometric view of a plastic bag that is commonly used in retail and grocery stores today.

A plastic bag, such as is commonly found in retail and grocery stores, is shown in FIG. 1 and indicated generally at 10. Bag 10 includes a generally rectangular bottom portion 12, a body portion 14 and a relatively narrow mouth or neck region 16. Extending upwardly adjacent neck region 16 are a pair of spaced-apart straps 18. The entire bag is formed of a thin, flexible plastic material, such as high density polyethylene, and can be collapsed along the pleats, which are shown at 19 in FIG. 1, to a generally planar configuration. Alternatively, bag 10 is often collapsed, or compressed, to a very small ball-like shape, especially after it has been used at least once to hold objects. Because of the bag's shape, with spaced-apart, generally opposed straps that extend upwardly from a neck portion, it is commonly referred to as a "T-shirt bag."

Figure 2:
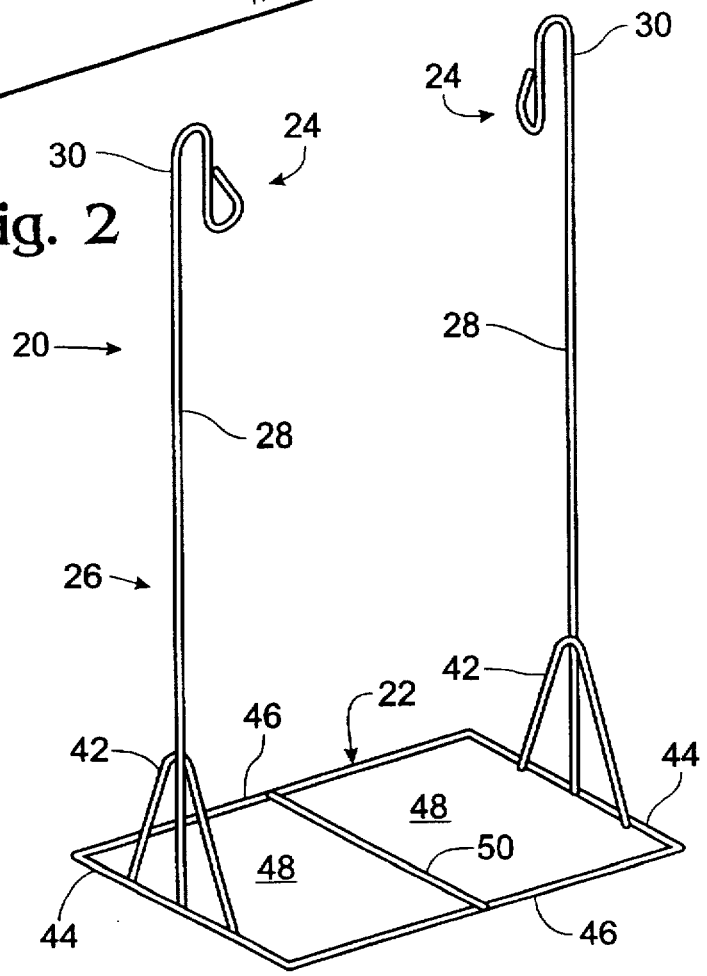
FIG. 2 is an isometric view of a holder for plastic bags that is constructed according to the present invention. The holder includes a base, a support structure and a pair of spaced-apart mounts that are each configured to selectively capture and support a respective one of the bag's straps above the base.
Figure 3:
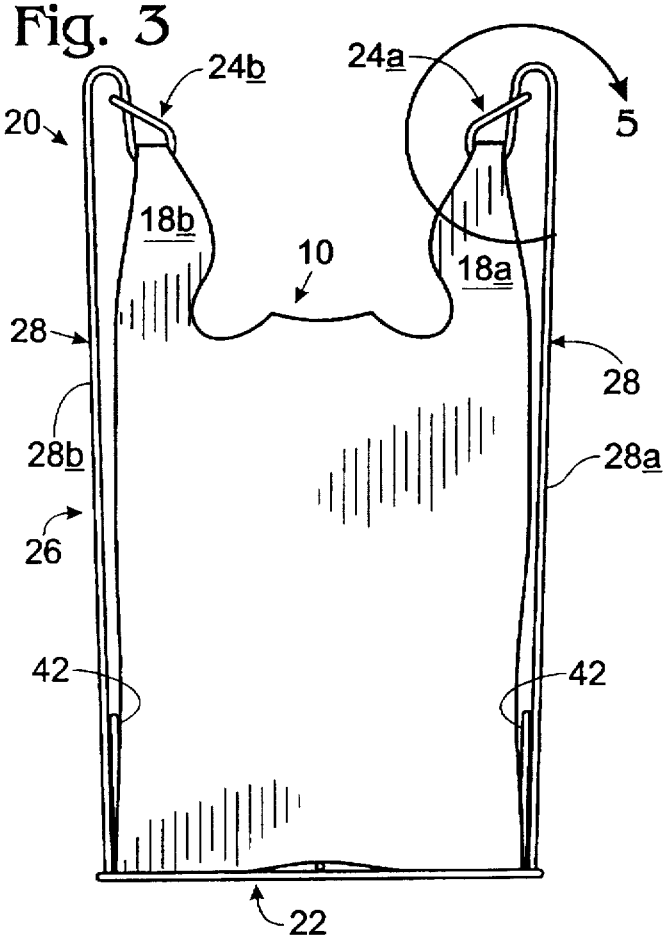
FIG. 3 is a front view of the holder of FIG. 2 shown supporting the bag of FIG. 1.
Figure 4:
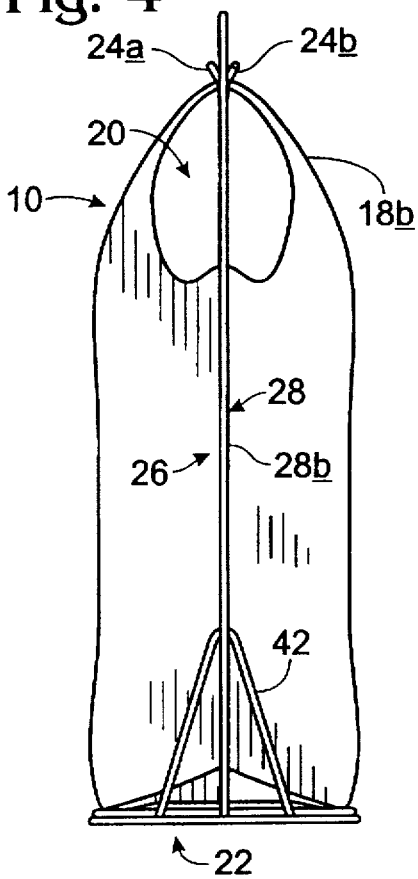
FIG. 4 is a side view of the holder and the bag shown in FIG. 3.

A bag holder constructed according to the present invention is shown in FIG. 2 and is generally indicated at 20. Holder 20 includes a base 22, a pair of spaced-apart mounts 24 and a support structure 26 that extends generally upwardly from base 22 and is connected to mounts 24 to maintain the mounts in a spaced relationship above the base. Support structure 26 is shown in its preferred form, which includes a pair of spaced-apart elongate members 28 with upper portions 30 distal base 22. Holder 20 is configured to selectively receive and support a collapsible bag having a pair of opposed straps, such as bag 10, which forms no part of the claimed invention. The holder maintains the bag in an upright, open position, as shown in FIGS. 3 and 4.

Each mount 24 is configured to capture a respective one of the straps on bag 10. Specifically, this means that strap **18*a* is captured and supporting by mount 24*a* while strap 18*b* is captured and supported by mount 24*b*. By captured, it is meant that the mount selectively receives and supports a strap while also preventing the unintentional removal of the strap from the mount. The mounts are maintained in a spaced-apart and generally opposed relationship above base 22 by the elongate members 28. Because both mounts 24*a* and 24*b* as well as both straps 18*a* and 18*b*, have similar configurations, the following detailed description of mount 24*a* and strap 18*a* is equally applicable to mount 24*b* and strap 18*b***.

Figure 5:
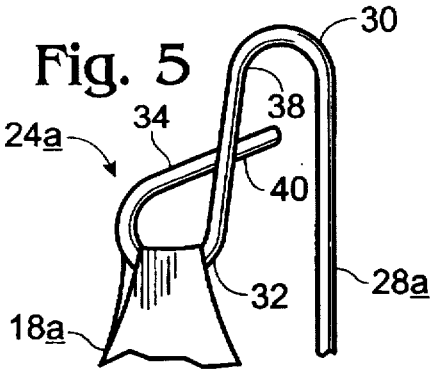
FIG. 5 is a fragmentary front detail taken along curved line 5 in FIG. 3, showing one of the mounts and a portion of the corresponding strap that it captures and supports.
Figure 6:
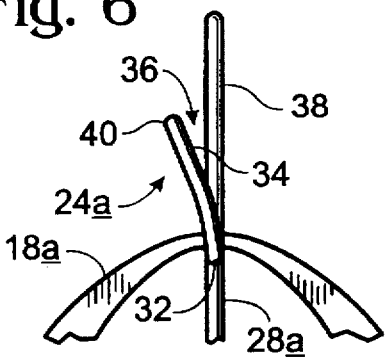
FIG. 6 is a side view of the mount and the strap shown in FIG. 5.
Figure 7:
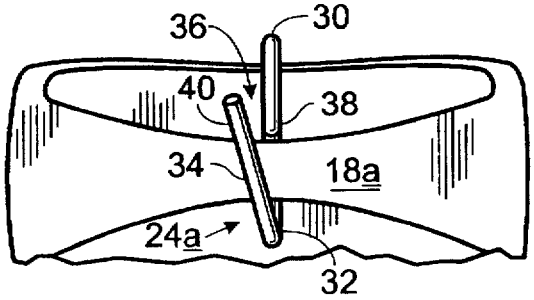
FIG. 7 is a top view of the mount and the strap shown in FIG. 5.

As seen in FIGS. 5–7, mount **24*a* includes a lower surface 32 for supporting strap 18*a* in a raised position above base 22. In addition, the mount further includes an upper surface 34 that is disposed above lower surface 32. Upper surface 34 selectively retains the strap within its corresponding mount and prevents the unintentional removal of the strap from the mount. Mount 24*a* forms, or defines, a narrow passage 36 through which strap 18*a*** is inserted and removed from the mount.

As shown, mount **24*a* supports strap 18*a* on lower surface 32 in an orientation generally transverse to a plane formed by the mount's lower and upper surfaces 32 and 34, respectively. In fact, mount 24*a* forms a closed boundary in a plane transverse to strap 18*a*. Because strap 18*a* is supported in a position that is also transverse to passage 36, the strap must be rotated until it is aligned with passage 36** in order to be inserted into or removed from the mount. This selective configuration of the mount prevents the unintentional removal of the strap once inserted within its corresponding mount.

Each mount further includes an intermediate region that connects the mount with the support structure. As seen in FIGS. 5–7, mount **24*a* includes intermediate region 38 that connects lower surface 32 to the upper portion 30 of member 28. Additionally, upper surface 34 extends at least partially adjacent intermediate region 38 to define passage 36. As shown in FIG. 7, upper surface 34 includes a terminal portion 40 that is adjacent, yet slightly spaced-apart from a portion of intermediate region 38. Passage 36** is formed between these regions.

As shown, terminal portion 40 extends beyond intermediate region 38. It should be understood, however, that the terminal region may be adjacent the intermediate region, yet in the same plane as the intermediate region. In this embodiment, the passage should be relatively narrow so that the straps may not be unintentionally removed from the mounts. The flexible, compressible material from which the straps are formed enables the straps to be inserted into and removed from the mounts through this narrow passage. On the other hand, when the passage is formed by the terminal member extending at least partially beyond the intermediate region, and thereby forming a closed boundary in a plane transverse to the strap, the passage may be larger because the strap must be rotated until it is aligned with the passage in order to be inserted into or removed from the mount.

Elongate member 28, intermediate region 38, lower surface 32 and upper surface 34 are all sequentially connected to form a single integral unit, as shown in FIGS. 5–7. It should be understood, however, that other forms of mounts 24 are intended to be within the scope of the invention. For example, the lower and upper surfaces of each mount may be discrete units that are each separately attached to member 28. Additionally, intermediate region 38 may be attached to upper surface 34, instead of lower surface 32.

As discussed, base 22 and mounts 24 are connected by a support structure 26, which maintains the mounts in a spaced-apart and generally opposed orientation above base 22. The support structure includes a pair of spaced apart members 28, as shown in FIGS. 3 and 4. Each member extends upwardly from base 22 and is connected to a respective one of the mounts. Specifically, member **28*a* is connected to mount 24*a*, and member 28*b* is connected to mount 24*b*. Each member has an elongate configuration with an upper portion 30 distal base 22 and includes a brace 42** that provides additional support and stability to the member.

In addition, members **28*a* and 28*b* are preferably configured to diverge slightly away from each other as they extend generally upwardly from the base. Specifically, each member is biased to extend away from base 22 at an angle greater than 90° measured from the base to the corresponding member. As shown, the members are each centrally mounted on opposite sides of base 22 and extend upwardly from the base and outwardly from each other. This configuration maintains the bag in an open position, even when fully loaded with trash or other items. It should be understood that as the quantity and weight of material in bag 10 increases, the upper portions of members 28 may be drawn slightly closer to each other, thereby bringing mounts 24** closer to each other. As a result, the bag will not be as open as it was previously. By biasing the members outwardly, however, the bag remains in an open and upright position, even when the bag is fully loaded with a substantial weight and quantity of materials.

Referring briefly back to FIG. 2, the reader can see that each member is connected to the intermediate region of its corresponding mount. It should be understood, however, that other selective couplings of members 28 to mounts 24 are possible and are intended to be within the scope of the invention, as long as one mount is maintained in an elevated position above base 22 by one member, and the other member maintains the second mount in an elevated position above base 22 and in a spaced-apart relationship to the first member. It should be further understood that support structure 26 is meant to include all forms of single and plural supports that are configured to maintain mounts 24 in a spaced-apart relationship above base 22.

As shown, the first elongate member and its corresponding mount, as well as the second elongate member and its mount, are each formed of a continuous, unitary expanse of material. Although the support structure is shown integrally mounted on the base, the support structure may be initially formed independent of the base and subsequently attached by welding, or other suitable forms of mechanical attachment, such as a clip or other binder that mounts the support structure on the base.

Also shown in FIG. 2 is the holder's base 22, which is sized to correspond generally to the shape of the bottom portion 12 of bag 10. This selective sizing allows the base to at least partially support a portion of the bag when the bag's straps are captured within mounts 24. As shown, the base includes opposed end walls 44 and opposed side walls 46 that collectively form a generally rectangular configuration that generally corresponds to bottom portion 12 of the bag. As seen in FIGS. 3 and 4, the bottom portion of bag 10 at least partially engages and rests against base 22, which as shown has a slightly larger perimeter than the bag's bottom portion. In addition, the base's side walls and end walls collectively define a central aperture 48 through which at least a portion of the bag's bottom portion 12 can extend. This configuration enables base 22 to constrain the lateral displacement of bottom portion 12 when the holder is moved by a user.

It should be understood that base 22 may have other configurations than the one shown in the figures. For example, base 22 could have other polygonal or arcuate configurations. In addition, the base may include at least one rib that spans the base's side walls or end walls to provide an additional surface on which the bottom portion of the bag may be seated and supported, as well as to provide additional stability to the holder. For example, in FIG. 2 a rib is indicated at 50 and extends between the central portions of the base's side walls. Additionally, base 22 may include a generally planar member, instead of the previously described framework.

Alternate embodiments of the holders are shown in FIGS. 11–14. In each embodiment, the support structures and mounts may include any of the previously described embodiments, although the bases are different, as discussed below.

Figure 11:
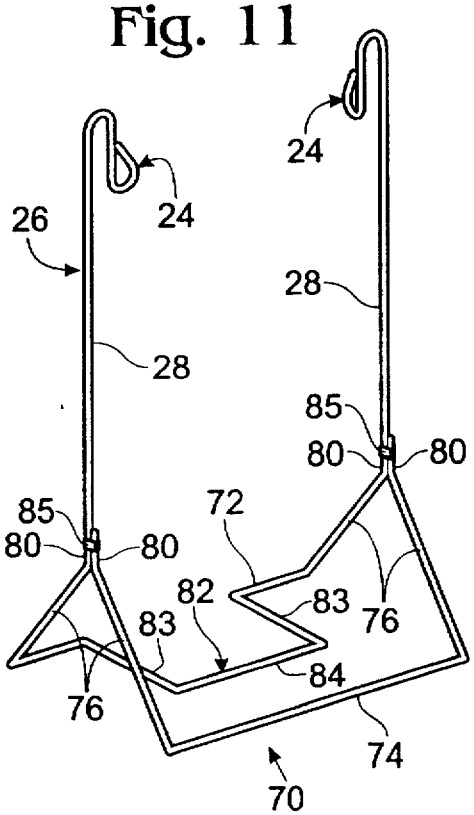
FIG. 11 is an isometric view of an alternate embodiment of the holder shown in FIG. 2.

In FIG. 11, the base is indicated generally at 70 and includes two members 72 and 74. Each member includes a pair of upwardly and inwardly extending end pieces 76 at the ends of each member. End pieces 76 have upper portions 80 that are coupled to the support structure. One of the members, such as member 72 shown in FIG. 11, includes an inwardly extending portion 82 that extends toward the other member in a plane formed by members 72 and 74. Inwardly extending portion 82 provides additional stability and support to the holder, and as shown includes a pair of laterally spaced transverse regions 83 that are joined by region 84, which extends generally parallel to members 72 and 74. In FIG. 11, member 72, support structure 26, and mounts 24 all are formed from the same length of wire to reduce manufacturing costs and assembly time. Member 74 is formed from a separate piece of wire and is joined to the first piece adjacent the lower portion of each elongate member 28 of the support structure. Any suitable means of mechanical fastening may be used to join member 74 to the support structure, although clips 85 are used in FIG. 1.

Figure 12:
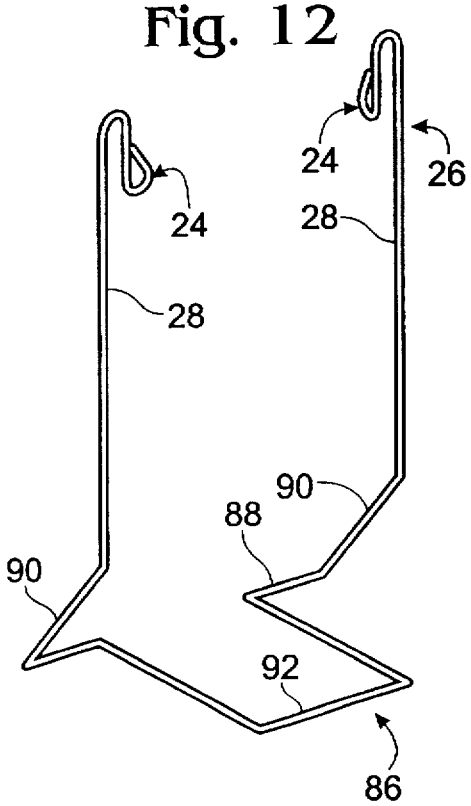
FIG. 12 is an isometric view of an alternate embodiment of the holder shown in FIG. 2.

Another embodiment of the base is shown in FIG. 12. In this embodiment, the base is indicated at 86 and includes a lateral member 88 that is similar to member 72 of the previously described embodiment. In this embodiment, however, the inwardly extending portion 90 extends beyond a plane formed by the elongate members of support structure 26 by a sufficient distance to provide a stabilizer and counterbalance for the support structure. As shown in FIG. 12, inwardly extending portion 90 extends approximately three inches beyond the plane formed by elongate members 28. Because member 86 stabilizes and supports the holder, this embodiment does not require a second support member, such as member 74 shown in FIG. 11. A further advantage of this embodiment is that the entire holder may be formed from a single continuous length of wire, which significantly reduces the cost and time to manufacture the holder.

Figure 13:
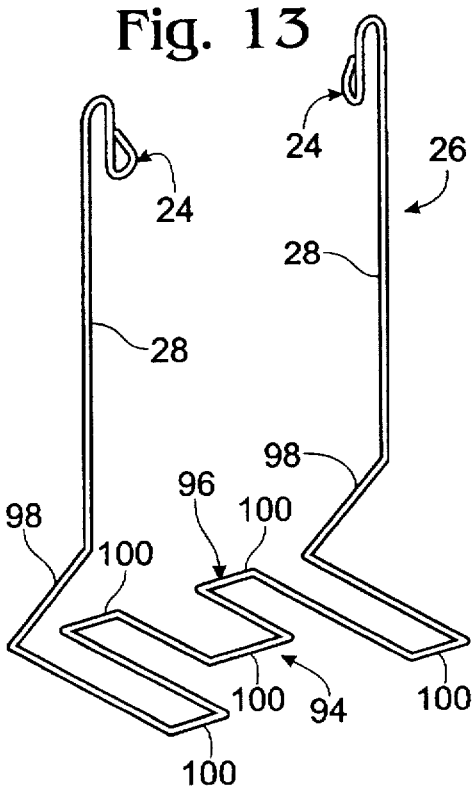
FIG. 13 is an isometric view of an alternate embodiment of the holder shown in FIG. 2.

In FIG. 13, the base is indicated generally at 94 and includes member 96, which has a pair of upwardly extending end regions 98 that are integrally connected to support structure 26. Therefore, the entire holder is formed from a single, continuous length of wire, which substantially reduces the time and expense to manufacture the holder. In this embodiment, member 96 has a stepped or notched configuration, with a plurality of sequential terminal portions 100 that are laterally spaced on alternating sides of the base to provide support for the holder.

Figure 14:
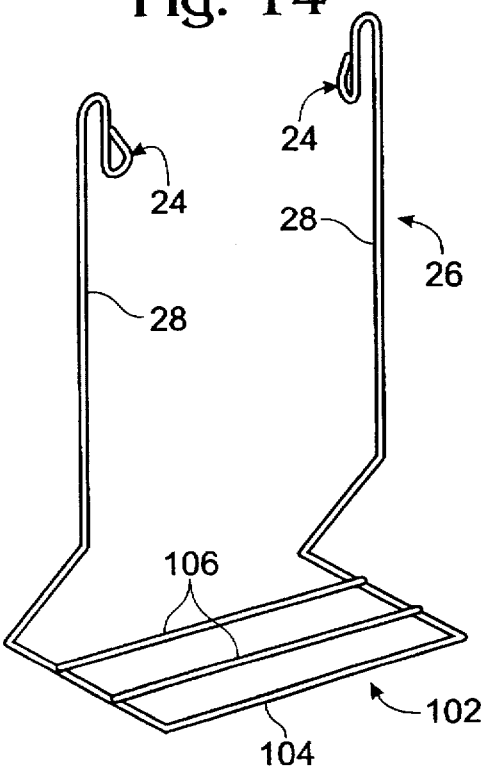
FIG. 14 is an isometric view of an alternate embodiment of the holder shown in FIG. 2.

In the embodiment shown in FIG. 14, the base is generally indicated at 102 and includes member 104. Member 104 is similar to the previously described member 96, except that instead of having a stepped configuration, member 104 defines a generally C-shaped frame that provides lateral and transverse support to the holder. In this embodiment, base 102 further includes a pair of spaced-apart ribs 106, which extend generally parallel to a plane connecting 28 elongate members. The ribs provide additional support and stability to the holder, and specifically support the bottom portion of a bag that is mounted on the holder.

The holder may further include a handle 52 that is configured to be selectively coupled to support structure 26. Although the handle could be coupled to the mounts, it is preferable that it is coupled to the support structure to prevent the handle from interfering with the straps as they are inserted into and removed from the mounts. Even more preferably, each member's upper portion 30 includes an arched region 54 to which the handle is coupled. As shown in FIG. 9, arched regions 54 are connected to intermediate regions 38 of each mount. Arched regions 54 may vary in size and dimensions, but should each extend above the corresponding mount by a sufficient distance to prevent the handle from interfering with the straps as they are respectively inserted into or removed from their corresponding mount.

As shown in FIG. 8, handle 52 includes a central portion 56 with a pair of spaced-apart fasteners 58 that extend away from the central portion. Fasteners 58 extend generally transverse to the handle's central portion, and are configured to be attached to the upper portions of members 28, and preferably to arched regions 54. Handle 52 includes two different fasteners 58, which are shown in FIG. 8 and indicated generally at 58*a* and 58*b*. The first fastener 58*a* is configured to engage and be slidable along at least a portion of member 28*a*. As shown, fastener 58*a* generally resembles a closed loop and is slidable along member 28*a*, although not removable from the member. Fastener 58*b* is configured to removably engage member 28*b* and may be any suitable mechanism for selectively and removably coupling the handle to the support structure. As shown, fastener 58*b* generally resembles a hook and includes a notched or crimped region 60 for selectively maintaining the fastener on elongate member 28*b*.

In FIG. 9, handle 52 is shown attached to holder 20. As indicated in dashed lines, members 28*a* and 28*b* are drawn slightly toward each other when coupled to their corresponding fasteners, 58*a* and 58*b*, respectively. The outward force exerted by the members against the fasteners retains handle 52 in a selected radial orientation with respect to the rest of the holder. When the handle's fasteners are each coupled to their respective members, the handle is in its "in use" position. As such, the handle may be used to lift the holder and an attached bag. Furthermore, because the handle's central portion 56 is disposed above mounts 24, and therefore substantially above an attached bag's neck 16, the holder does not interfere with a user loading objects into or removing objects from the bag.

The handle 52 may be selectively stored along holder 20 in an "at rest" position. As indicated in dashed lines at 52', the handle is stored along one of the support structure's members 28, specifically member 28*a*. Handle 52 is switched between its at rest and in use positions by first uncoupling fastener 58*b* from the upper portion of its corresponding member. Next, fastener 58*a* is slid along its member, 28*a*, until it is adjacent brace 42. Once in this position, fastener 58*b* is reattached to member 28*a* above fastener 58*a*, thereby storing the handle along member 28*a*. It should be understood that the handle may be stored along member 28*a* in other ways as well. For example, once fastener 58*b* is unattached from member 28*b*, the handle may be pivoted about fastener 58*a*, and fastener 58*b* may be reattached to member 28*a* adjacent brace 42.

It should be understood that other forms of handles that are configured to be selectively coupled to the holder are meant to be within the scope of the invention. For example, the handle may include a pair of fasteners that are similar to the previously described fastener 58*b*. As shown in FIG. 10, each fastener 58' may be selectively coupled to or removed from the support structure. This enables the handle to be completely removed from the holder, as well as to be stored along one of the support structure's members when both fasteners are unattached from their in use positions and reattached along the same member. Additionally, handle 52 may further include a grip 62 that makes the handle easier to grasp and hold. As shown in FIG. 10, grip 62 is of a larger diameter than central portion 56. It should be understood that a grip could also be used with handle 52, which is shown in FIGS. 8 and 9.

In the preferred embodiments shown and described above, the holder is constructed of a sturdy wire, such as ten gauge cold rolled steel. The construction shown above minimizes the weight, quantity of materials, and assembly time to make the holder. It should be understood that the holder may be constructed of other materials as well, such as tubes, other forms of wire, and injection molded materials, such as plastic, as long as the material has the structural integrity to support the bag and its contents. The selected material should also be impervious to moisture so that it may be easily cleaned and will not deteriorate or corrode over time. When metallic materials are used to construct the holder, it is therefore preferable that they be coated or otherwise treated to resist corrosion.

Finally, although the holder is specifically designed for use with the previously described T-shirt bags, it should be understood that it is intended to be within the scope of the invention that the holder could be used on other bags that are constructed of a flexible or collapsible material and include a neck with a pair of spaced-apart handles. Examples of other bags that could be used with the present invention are reusable shopping bags that are generally made of cloth or other fabric-like materials.

The previously described holder is particularly useful when a user needs to transport bags from place to place while the bags are loaded with materials. Because the holder supports that bag and its straps in an upright position, the user can set the holder and bag assembly on the ground or other surface without having the bag collapse, thereby spilling its contents. This is particularly beneficial when the user lacks the strength, ability or desire to hold the bag in a raised position for long periods of time.

Additionally, even if the bag does not spill its contents when released, the bag's straps still will generally collapse once released by the user. This requires the user to reach down close to the base of the bag to pick up the straps. If the bag is supported within the holder, however, the straps are maintained in an elevated, upright position and are readily grasped without requiring the user to reach near the ground.

While preferred embodiments of the invention have been described, it should be obvious that variations and modifications thereto are possible without departing from the spirit and scope of the invention.

I claim:

1. A holder for a bag having a bottom portion, a neck and two spaced-apart straps connected to the neck, the holder comprising:

a base;

a pair of spaced-apart mounts that are each configured to capture and support a respective one of the bag's straps, each mount including a lower surface for supporting the strap in a raised position above the base and an upper surface disposed above the lower surface for selectively retaining the strap within the corresponding mount and preventing the unintentional removal of the strap from the mount; and a support structure extending upwardly from the base and connected to the mounts to maintain the mounts in a spaced relationship above the base.

2. The holder of claim 1, wherein each mount includes a narrow passage through which a respective one of the bag's straps may be inserted into and removed from the mount.

3. The holder of claim 2, wherein each mount is configured to support its corresponding strap in an orientation transverse to the passage in the mount, thereby requiring the strap to be rotated until it is aligned with the passage in order to be removed from the mount.

4. The holder of claim 1, wherein each mount's lower and upper surfaces collectively form a closed boundary in a plane transverse to one of the bag's straps when the strap is captured within the mount.

5. The holder of claim 1, wherein the support structure includes a pair of spaced-apart elongate members, each elongate member extending generally upwardly from the base and being connected to a respective one of the mounts to support that mount in an elevated position above the base.

6. The holder of claim 5, wherein the members diverge slightly away from each other as they extend generally upwardly from the base.

7. The holder of claim 5, wherein each of the members includes an arched region, and wherein the holder includes a handle that is removably coupled to the arched regions.

8. The holder of claim 5, wherein each of the members includes an arched region, and the holder further comprises a handle with a pair of spaced-apart fasteners, the first fastener configured to engage and be slidable along at least a portion of a first one of the members and the second fastener configured to engage a second one of the members and to be selectively detached from the second member and reattached to the first member to enable the handle to be stored along the first member.

9. The holder of claim 5, wherein the holder is constructed of wire.

10. The holder of claim 5, wherein the base is sized to correspond generally to the shape of the bag's bottom portion, and the members are sized to support the straps at a height above the base that enables the base to at least partially support the bag.

11. The holder of claim 1, wherein the base has opposed end walls and opposed side walls that collectively form a generally rectangular configuration that generally corresponds to and at least partially supports the bottom portion of the bag, the end walls and side walls collectively defining a central aperture through which at least a portion of the bag's bottom portion can extend for constraining lateral displacement of the bag's bottom portion when the holder is moved.

12. The holder of claim 1, wherein the holder includes a handle that is removably coupled to the support structure.

13. A holder for a bag having a bottom portion, a neck and a pair of spaced-apart straps connected to the neck, the holder comprising:

a base;

a pair of spaced-apart elongate members extending generally upwardly from the base, each member having an upper portion distal the base; and a pair of spaced-apart mounts that are each configured to capture and support a respective one of the bag's straps in an elevated position above the base, each mount including an intermediate region connected to the upper portion of a respective one of the members and extending generally downwardly therefrom, a lower surface connected to the intermediate region and adapted to support a respective one of the bag's straps in an elevated position above the base, and an upper surface connected to the lower surface and extending at least partially adjacent the intermediate region to capture and selectively retain the strap within the mount and to define a narrow passage between at least a portion of the intermediate region and the upper surface through which the strap may be selectively inserted into and removed from the mount.

14. The holder of claim 13, wherein the mounts are configured to support the straps in an orientation transverse to the passages, thereby requiring the straps to be rotated until they are aligned with the passages in order to be removed from the mounts.

15. The holder of claim 13, wherein the intermediate region, lower surface and upper surface of each mount collectively form a closed boundary in a plane transverse to one of the bag's straps when the strap is captured within the mount.

16. The holder of claim 13, wherein the holder includes a handle that is removably coupled to the upper portions of the members.

17. The holder of claim 16, wherein each of the upper portions of the members includes an arched region, and the handle is removably coupled to the arched regions.

18. The holder of claim 16, wherein each of the members includes an arched region, and the holder further comprises a handle with a pair of spaced-apart fasteners, a first fastener configured to engage and be slidable along at least a portion of a first one of the members and a second fastener configured to engage a second one of the members and to be selectively detached from the second member and reattached to the first member to enable the handle to be stored along the first member.

19. The holder of claim 13, wherein the holder is constructed of wire.

20. The holder of claim 13, wherein the base is sized to correspond generally to the shape of the bag's bottom portion, and the members are sized to support the straps at a height above the base that enables the base to at least partially support the bag.

21. The holder of claim 13, wherein the base has opposed end walls and opposed side walls that collectively form a generally rectangular configuration that generally corresponds to and at least partially supports the bottom portion of the bag, the end walls and side walls collectively defining a central aperture through which at least a portion of the bag's bottom portion can extend for constraining lateral displacement of the bag's bottom portion when the holder is moved.

22. The holder of claim 13, wherein the members diverge slightly away from each other as they extend generally upwardly from the base.

* * * * *